United States Patent [19]

Morita et al.

[11] Patent Number: 5,074,934

[45] Date of Patent: Dec. 24, 1991

[54] FLEXIBLE HOT ROLLED STEEL SHEETS HAVING IMPROVED DEEP DRAWABILITY

[75] Inventors: Masahiko Morita; Koichi Hashiguchi; Fusao Togashi, all of Chiba, Japan

[73] Assignee: Kawasaki Steel Corporation, Japan

[21] Appl. No.: 505,887

[22] Filed: Apr. 5, 1990

[51] Int. Cl.[5] ..... C22C 38/06

[52] U.S. Cl. ..... 148/333; 148/320

[58] Field of Search ..... 148/333, 12 C, 320; 420/104

[56] References Cited

U.S. PATENT DOCUMENTS 4,331,488 10/1980 Sudo et al. ..... 148/12 C

FOREIGN PATENT DOCUMENTS 2155360 5/1973 France .
2320992 11/1977 France .
55-131131 10/1980 Japan ..... 148/12 C
58-84929 5/1983 Japan ..... 148/12 C
1287178 8/1972 United Kingdom .

*Primary Examiner*—Deborah Yee
*Attorney, Agent, or Firm*—Austin R. Miller

[57] ABSTRACT

A flexible hot rolled steel sheet having an improved deep drawability comprises not more than 0.10 wt % of C, less than 0.20 wt % of Mn, 0.10–2.0 wt % of Cr, 0.002–0.100 wt % of Al, and the balance being Fe and inevitable impurities or further contains particular amounts of at least one of Ti, Nb and Zr and/or B. Such a hot rolled steel sheet has a tensile strength of not more than 35 kgf/mm$^2$ and a total elongation of not less than 50%.

5 Claims, 3 Drawing Sheets

FLEXIBLE HOT ROLLED STEEL SHEETS HAVING IMPROVED DEEP DRAWABILITY

BACKGROUND OF THE INVENTION

1. Field of the Invention

This invention relates to flexible hot rolled steel sheets having a tensile strength of not more than 35 kgf/mm$^2$ and a total elongation of not less than 50% and an improved deep drawability and good bending property and bulging property.

2. Related Art Statement

Lately, manufacturers for automobiles, domestic electrical articles and the like tend to use thin hot rolled steel sheets instead of cold rolled steel sheets from a viewpoint of the reduction of cost. However, conventional hot rolled steel is poor in deep drawability as compared with cold rolled steel sheet, so that their application is restricted at the present.

The deep drawability of the steel sheet is dependent upon the elongation property of the starting material and r-value. As a cause which the conventional hot rolled steel sheet is hardly applied to the deep drawing, in the hot rolled steel sheet produced by the usual method, the level of r-value is not more than 1.0 and it is difficult to obtain the r-value of not less than 1.5 as in the cold rolled steel sheet.

A countermeasure for improving the drawback on the deep drawability in hot rolled steel sheets is roughly divided into two methods, one being a method of approaching the r-value to that of the cold rolled steel sheet as far as possible and the other being a method of largely improving the elongation property.

As to the first method, Japanese Patent laid open No. 55-97431, No. 60-77927 and the like have proposed a method wherein steel having the conventionally used chemical composition is used and hot rolled under such a finish hot rolling condition that the reduction is high or the strain rate is high or the reduction is carried out within a particular low temperature range to thereby improve the r-value.

However, even if the above method is adopted, the resulting r-value is 1.0–1.3 at most and does not reach to the level of the cold rolled steel sheet, so that the deep drawability is not yet satisfied at the present. Furthermore, if it is intended to obtain a higher r-value by the above method, it is necessary to largely change the hot rolling condition from the usually used range toward high reduction side and high speed rolling side, which finally exceeds over the range of rolling conditions selectable in the existing hot rolling mill.

On the other hand, as a proposal for the improvement of elongation property on the latter deep drawability, there are mentioned hot rolled steel sheets obtained by adding B to the chemical composition in the usual flexible hot rolled steel sheet and regulating the weight ratios of B/N and Mn/S within given ranges, respectively, as disclosed in Japanese Patent laid open No. 62-139849. However, the total elongation of such a hot rolled steel sheet is not more than 48%, and even when the best properties of the hot rolled steel sheet are compared with the properties of the cold rolled steel sheet, they are only equal to the level of the cold rolled steel sheet at most.

SUMMARY OF THE INVENTION

It is, therefore, an object of the invention to provide flexible hot rolled steel sheets having a very excellent elongation property, concretely flexible hot rolled steel sheets having a tensile strength of not more than 35 kgf/mm$^2$ and a total elongation of not less than 50% and an improved deep drawability.

The term "tensile strength" used herein means a tensile strength using a tensile test specimen of JIS No. 5, while the elongation property is a value of total elongation using a tensile test specimen of JIS No. 5 with a thickness of 1.4 mm. Moreover, when the thickness of the specimen is different, the total elongation is represented by the value of El* corrected according to the following equation:

$$El^* = (1.4/t)El_t \quad (1)$$

wherein t is the thickness of the tensile test specimen (mm) and $El_t$, is the total elongation of the tensile test specimen at the thickness t (%).

It is known that in the case of steel sheets having a thickness of not more than 1.0 mm as in cold rolled steel sheets, the reduction of the thickness in the press forming depends on the forming limit, so that the deep drawability becomes high in the depending ratio to the r-value rather than the elongation property, while in the case of steel sheets having a thickness of not less than 1 mm as in hot rolled steel sheet, the influence by the reduction of the thickness is mitigated, so that the deep drawability is small in the depending ratio to r-value and becomes relatively high in the depending ratio to the elongation property.

Under the above circumstances, the inventors have developed a means for considerably improving the deep drawability of hot rolled steel sheet through the improvement of the elongation property and made various studies, and found hot rolled steel sheets having an r-value equal to that of the conventional steel and elongation property considerably higher than that of the conventional steel, and consequently the invention has been accomplished.

That is, a first embodiment of the invention lies in a flexible hot rolled steel sheet having an improved deep drawability, comprising not more than 0.10 wt % (hereinafter shown by simply) of C, less than 0.20% of Mn, 0.10–2.0% of Cr, 0.002–0.100% of Al, and the balance being Fe and inevitable impurities Further, a second embodiment of the invention lies in a flexible hot rolled steel sheet having an improved deep drawability, comprising not more than 0.10% of C, less than 0.20% of Mn, 0.10–2.0% of Cr, 0.002–0.100% of Al, 0.005–0.10% in total of at least one of Ti, Nb and Zr, and the balance being Fe and inevitable impurities.

And also, a third embodiment of the invention lies in a flexible hot rolled steel sheet having an improved deep drawability, comprising not more than 0.10% of C, less than 0.20% of Mn, 0.10–2.0% of Cr, 0.002–0.100% of Al, 0.0004–0.0100% of B, and the balance being Fe and inevitable impurities.

Moreover, a fourth embodiment of the invention lies in a flexible hot rolled steel sheet having an improved deep drawability, comprising not more than 0.10% of C, less than 0.20% of Mn, 0.10–2.0% of Cr, 0.002–0.100% of Al, 0.005–0.10% in total of at least one of Ti, Nb and Zr, 0.0004–0.0100% of B, and the balance being Fe and inevitable impurities.

BRIEF DESCRIPTION OF THE DRAWINGS

The invention will be described with reference to the accompanying drawings, wherein.

DESCRIPTION OF THE PREFERRED EMBODIMENTS

Figure 1:
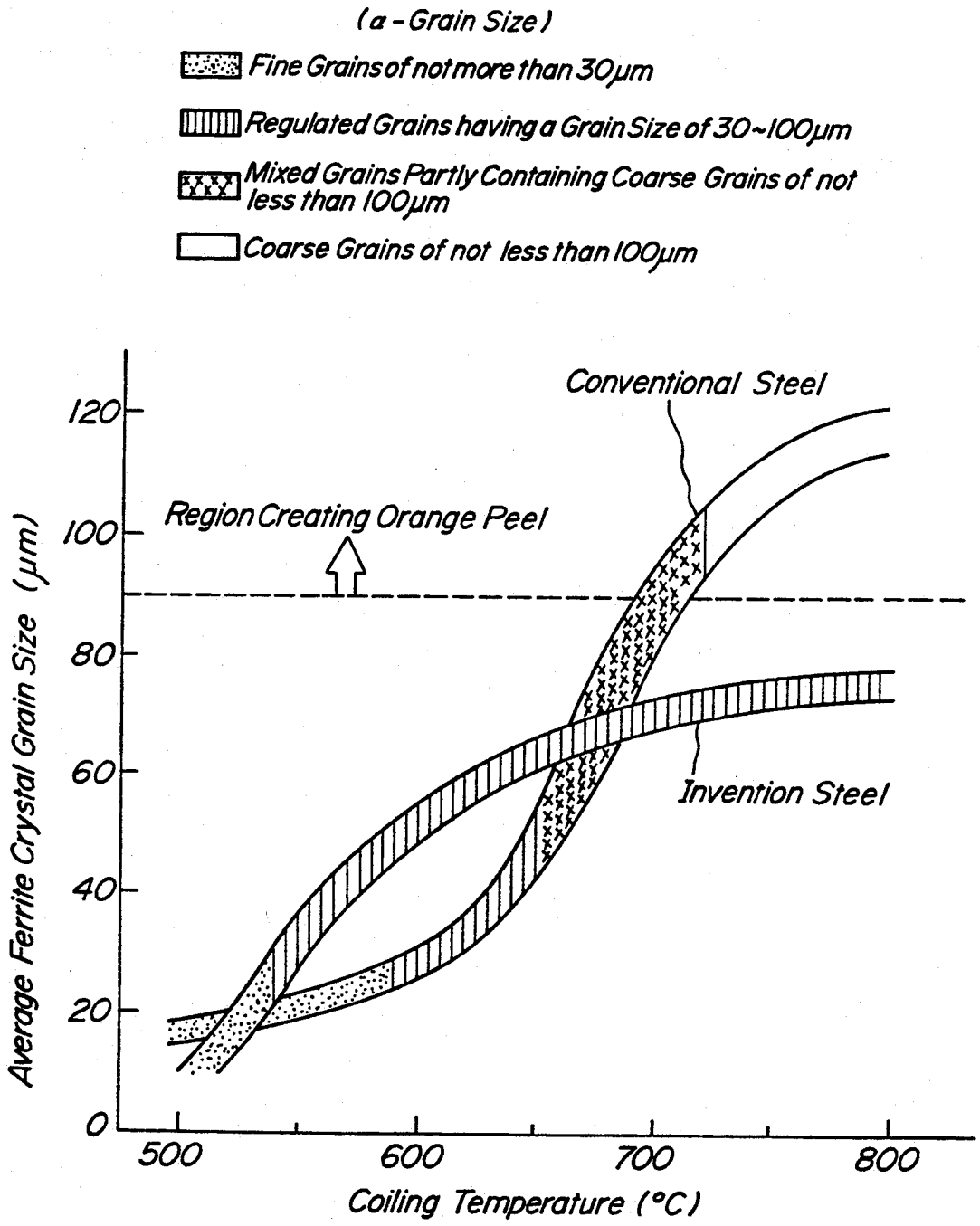
FIG. 1 is a graph showing the difference in the ferrite crystal grain size to the coiling temperature between the steel according to the invention and the conventional steel.

The flexible hot rolled steel sheets according to the invention will concretely be described below.

The flexible hot rolled steel sheet according to the invention is a low carbon aluminum killed steel containing not more than 0.10% of C, wherein Cr is included in an amount of 0.10–2.0% while controlling the amount of Mn to a low range of less than 0.20%. The chemical composition range of the flexible hot rolled steel sheet according to the invention is determined by the following alloy formulation to ensure a tensile strength of not more than 35 kgf/mm$^2$ and total elongation of not less than 50%.

That is, when the hot rolling is carried out under usual rolling conditions, in order to render the sheet into flexible material as far as possible, it is required to completely eliminate strength raising factors such as texture reinforcement, solid solution reinforcement, precipitation hardening and the like and to regulate crystal grains as a microstructure so as to have a ferrite crystal grain size of 20–100 μm. For this purpose, according to the invention, the chemical composition range is specified as mentioned above. The reason on the limitation of the chemical composition range will be described below.

C: not more than 0.10%

The C amount should be not more than 0.10% in order to obtain a flexible hot rolled steel sheet. When the C amount exceeds 0.10%, the tensile strength also exceeds 35 kgf/mm$^2$, and consequently the total elongation of not less than 50% aiming at the invention can not be obtained. Moreover, as the C amount becomes small, the steel sheet becomes more flexible and the high elongation property is easy to be obtained, so that the C amount is desirable to be not more than 0.025%. However, the lower limit of the C amount is about 0.0010% from a viewpoint of steel-making restriction. Even when the amount is within a range of 0.025–0.10%, the tensile strength aiming at the invention is obtained by properly selecting amounts of Mn and Cr as mentioned later.

Mn: less than 0.20%

The Mn amount is necessary to be controlled to be less than 0.20% for providing the high elongation property for the following two reasons. The first reason is to suppress the rising of the tensile strength due to the solid solution reinforcement with Mn, and the second reason is to prevent the fine division of ferrite crystal grains produced from the lowering of ferrite transformation starting temperature by the action of Mn decreasing $A_{r3}$ point to thereby suppress the rising of tensile strength due to such a fine division. When the Mn amount exceeds 0.20%, the above Mn action can not be suppressed, and consequently the tensile strength of not more than 35 kgf/mm$^2$ and total elongation of not less than 50% aiming at the invention can not be obtained. Moreover, when the Mn amount is less than 0.01%, the action for fixing S is reduced to cause a fear of creating hot shortness, so that the amount of about 0.01% may be added at minimum.

Cr: 0.10–2.0%

The Cr amount is necessary to be within a range of 0.10–2.0% for preventing the bad influence of solid solute C and optimizing the microstructure. According to the invention, the point that the Cr amount is adjusted to the above range is an essential point. In this connection, the knowledge found from the inventors' studies will be described in detail below.

As a mean adopted for producing the flexible hot rolled steel sheet, there are generally well-known a method of reducing the strength raising element such as C, Mn or the like as far as possible, and a method of raising the hot finish temperature or coiling temperature to enlarge the ferrite crystal grain size. However, the inventors have found that even if these methods are conducted, the level of the resulting elongation property is critical due to the remaining solid solute C or formation of film-like cementite at grain boundary, abnormal increase of ferrite crystal grain size and the like and consequently the high elongation property of not less than 50% aiming at the invention is never obtained only by these methods.

The reason why the solid solute C is easy to remain as the C amount is decreased in the conventional hot rolled steel sheet is due to the fact that the supersaturation degree of C soluted in steel is reduced to make the driving force for precipitation as a carbide weak and also the precipitation nucleus is decreased by the formation of coarse crystal grain. Particularly, when the C amount is as low as 0.02%, if the precipitation of cementite at grain boundary is promoted, the film-like cementite is produced in the boundary of ferrite crystal grains to degrade the elongation property.

As a means for preventing the remaining of solid solute C or the formation of film-like cementite, there is also known a method of adding a carbide-forming element such as Ti, Nb, Zr or the like. When this method is particularly applied to extremely low carbon steel containing not more than 0.0050% of C, fairly effective results are obtained, but considerable improvement of the elongation property is not achieved. Because, in order to sufficiently eliminate the bad influence of solid solute C by the addition of the carbide-forming element, it is necessary that the ratio of carbide-forming element to the amount of C is at least 10 as an atomic %, but the effect of raising the strength by the addition of the carbide-forming element itself is caused to finally disappear the improving effect through the reduction of solid solute C.

The inventors have found that the above inconvenience can advantageously be improved by the effect of Cr.

At first, the addition of Cr eliminates the bad influence of solid solute C and prevents the formation of the film-like cementite. Although the detailed mechanism of this phenomenon is not clear, the following is believed to occur. That is, Cr is not a strong carbide-forming element as in Ti, Nb and Zr, but strongly tends to form a carbide as compared with Fe or Mn, so that when Cr is existent together with solid solute C, it is considered to hold a state of locally existing solid solute C atom around a Cr atom by the interaction between both the atoms. In this case, C exists at the same state as precipitated as a carbide, i.e. a state that the amount of solid solute C is reduced at a greater part of a matrix to cause no solid solution reinforcement on one hand and at a state of forming no carbide to prevent the formation of the film-like cementite on the other hand. By such an addition of Cr, the existing state of C is very advantageously held in view of the mechanical properties. As is well-known, the solid solution reinforcing amount of Cr itself is very small as compared with that of Mn or the like, so that increasing strength by Cr addition is small to bring about the favorable result.

The second effect by Cr addition that the regulated structure of ferrite grains having good grain size is easy to be obtained. In order to promote the flexible material of the hot rolled steel sheet and the improvement of the elongation property, it is required that the ferrite crystal grain size is rendered into a grain regulated structure sufficiently grown within a range of causing no orange peel. In order to obtain such a structure, it is desirable that the hot rolling finish temperature and the coiling temperature are higher, but in the production of the conventional steel there is a problem that the range of the optimum coiling temperature is very narrow. FIG. 1 schematically shows the difference of the relation between the coiling temperature and the ferrite crystal grain size in the conventional steel and the Cr-containing steel according to the invention. As seen from FIG. 1, when the coiling temperature exceeds a certain value in the conventional steel, the phenomenon of abnormal grain growth rapidly occurs to exhibit the mixed grain structure and hence the coarse grain structure being orange peel. Therefore, in order to avoid such a risk to provide the regulated grain structure, the range selectable as the coiling temperature is relatively low and narrow, and consequently the resulting ferrite crystal grain size is insufficient. On the other hand, in the Cr-containing steel according to the invention, the abnormal grain growth is suppressed and the crystal grain growth gently proceeds together with the rising of the coiling temperature, and consequently the regulated grain structure having an optimum grain size is easily obtained.

In order to develop the above effect, Cr is necessary to be added in an amount of at least 0.10%, while when the Cr amount exceeds 2.0%, the tensile strength rises and it is difficult to attain the tensile strength of not more than 35 kgf/mm$^2$ aiming at the invention, so that the upper limit is 2.0%.

Al: 0.002–0.100%

Al improves the cleanness of steel as a deoxidizing component and fixes N to prevent the degradation of the elongation property at strain aging, so that it is an essential component in the invention.

In order to develop the above effect, Al is necessary to be added in an amount of at least 0.002%, while when the Al amount exceeds 0.100%, the effect is saturated and also AlN rather increases to obstruct the growth of ferrite crystal grains. For this end, the Al amount should be within a range of 0.002–0.100%.

In the invention, the object can be fundamentally achieved by regulating the C, Mn and Cr amounts, but the deep drawability is further improved by adjusting other chemical components to the range as mentioned later.

In the second and fourth embodiments, at least one of Ti, Nb and Zr is included in an amount of 0.005–0 10% in total. Ti, Nb and Zr form a carbide to reduce solid solute C, so that when they are added in a proper amount, the deep drawability is improved. In order to develop this effect, after the C amount is limited to not more than 0.020%, the ratio as atomic % of the total amount of the above components to C amount 7 is sufficient to be within a range of 1–5. However, when the ratio is less than 1, the addition effect of these components is not developed. Moreover, when the ratio exceeds 5, the tensile strength inversely rises to degrade the elongation property. Therefore, at least one of Ti, Nb and Zr is added in an amount of 0.005–0.1000% in total.

B: 0.0004–0.0100%

In the third and fourth embodiments, B is included in an amount of 0.0004–0.0100%. B advantageously serves to prevent the strain aging through N and acts as a nucleus for precipitating supersaturated solid solute C when BN is precipitated, so that when the B amount is a proper range, the deep drawability is improved. When the B amount is less than 0.0004%, the above effect is not developed, while when it exceeds 0.0100%, there is a fear of degrading the elongation property. Preferably, B is added in an amount of not more than 0.0050%.

N causes the solid solution reinforcement and degradation through strain aging likewise C and also forms AlN to obstruct the growth of ferrite crystal grain, so that the N amount is desirable to be reduced as far as possible. Preferably, the N amount is not more than 20 ppm.

P easily segregates into grain boundary to cause secondary work brittleness and raises the strength of matrix through solid solution reinforcement, so that the P amount is desirable to be reduced as far as possible. Preferably, the P amount is not more than 0.012%.

S badly affects the elongation property as a non-metallic inclusion and acts to promote hot shortness and secondary work brittleness, so that the S amount is desirably not more than 0.010%.

The flexible hot rolled steel sheets according to the invention ca be produced by hot rolling steels having the above chemical composition according to the usual manner. The production conditions are not particularly restricted, but the finish rolling at a temperature of not lower than $A_{r3}$ point is most general, and in this case good mechanical properties can be obtained as the finish rolling temperature becomes higher. In the flexible hot rolled steel sheet according to the invention, even if the finish rolling temperature is as low as a range of 750° C.-$A_{r3}$ point, the recrystallization ferrite structure of regulated grains can be obtained by adjusting the reduction at final pass to not less than 20%, and consequently good mechanical properties ar obtained likewise in the case of high temperature finish rolling. Because, the recrystallization of the worked ferrite crystal grains is easily promoted by the addition of Cr, so that the recrystallization is caused at a final pass reduction of not less than 20%. Thus, the point that the good mechanical properties are obtained even at a low finish rolling temperature of not higher than $A_{r3}$ point is suitable for the production of thin hot rolled steel sheets having a thickness of about 1.0–2.0 mm which tend to increase the demand lately.

Furthermore, the coiling temperature is desirable to be not lower than 550° C for making the hot rolled steel sheet flexible and improving the elongation property. The upper limit of the coiling temperature is not particularly restricted from a viewpoint of the mechanical properties, but it is desirable to be not higher than 750° C. from a viewpoint of the pickling.

The following example is given in illustration of the invention and is not intended as limitation thereof.

In the hot rolled steel sheets according to the invention, the rolling conditions are not particularly restricted to those described in this example.

EXAMPLE

Steels having a chemical composition as shown in the following Table 1 were rolled to a thickness of 1.4 mm under hot rolling conditions as shown in the following Table 2 to obtain hot rolled steel sheets. Then, the tensile properties, elongation property and limit drawing ratio (L.D.R.) were measured with respect to these hot rolled steel sheets to obtain results as shown in Table 2.

TABLE 1

| Steel No. | C | Si | Mn | Cr | Ti | Nb | Zr | B | Al | N | P | (wt %) S |
|---|---|---|---|---|---|---|---|---|---|---|---|---|
| Comparative steel 1 | 0.0250 | 0.01 | 0.25 | 0.02 | — | — | — | — | 0.035 | 0.0026 | 0.008 | 0.005 |
| Comparative steel 2 | 0.0105 | 0.01 | 0.25 | 0.01 | — | — | — | — | 0.038 | 0.0022 | 0.011 | 0.008 |
| Comparative steel 3 | 0.0022 | ≦0.01 | 0.16 | 0.01 | 0.036 | 0.013 | — | — | 0.053 | 0.0031 | 0.006 | 0.007 |
| Invention steel 4 | 0.0025 | ≦0.01 | 0.06 | 0.51 | — | — | — | — | 0.015 | 0.0017 | 0.012 | 0.005 |
| Invention steel 5 | 0.0098 | ≦0.01 | 0.07 | 0.50 | — | — | — | — | 0.015 | 0.0021 | 0.009 | 0.006 |
| Invention steel 6 | 0.0352 | ≦0.01 | 0.07 | 0.30 | — | — | — | — | 0.012 | 0.0018 | 0.011 | 0.006 |
| Invention steel 7 | 0.0951 | ≦0.01 | 0.08 | 0.51 | — | — | — | — | 0.013 | 0.0018 | 0.006 | 0.007 |
| Comparative steel 8 | 0.1200 | ≦0.01 | 0.08 | 0.50 | — | — | — | — | 0.016 | 0.0017 | 0.009 | 0.005 |
| Invention steel 9 | 0.0100 | ≦0.01 | 0.15 | 0.51 | — | — | — | — | 0.012 | 0.0016 | 0.013 | 0.005 |
| Comparative steel 10 | 0.0110 | ≦0.01 | 0.25 | 0.50 | — | — | — | — | 0.011 | 0.0019 | 0.011 | 0.005 |
| Invention steel 11 | 0.0021 | ≦0.01 | 0.06 | 1.05 | — | — | — | — | 0.012 | 0.0026 | 0.009 | 0.005 |
| Invention steel 12 | 0.0022 | ≦0.01 | 0.06 | 1.52 | — | — | — | — | 0.008 | 0.0018 | 0.013 | 0.008 |
| Invention steel 13 | 0.0020 | ≦0.01 | 0.07 | 1.90 | — | — | — | — | 0.013 | 0.0015 | 0.009 | 0.007 |
| Comparative steel 14 | 0.0031 | ≦0.01 | 0.08 | 2.20 | — | — | — | — | 0.014 | 0.0017 | 0.011 | 0.005 |
| Invention steel 15 | 0.0029 | ≦0.01 | 0.05 | 0.50 | — | 0.031 | — | — | 0.015 | 0.0035 | 0.006 | 0.006 |
| Invention steel 16 | 0.0022 | ≦0.01 | 0.06 | 0.52 | 0.030 | — | — | — | 0.012 | 0.0019 | 0.009 | 0.006 |
| Invention steel 17 | 0.0022 | ≦0.01 | 0.06 | 0.50 | — | — | 0.033 | — | 0.013 | 0.0019 | 0.013 | 0.007 |
| Invention steel 18 | 0.0034 | ≦0.01 | 0.07 | 0.50 | 0.045 | 0.015 | — | — | 0.016 | 0.0017 | 0.008 | 0.005 |
| Invention steel 19 | 0.0032 | ≦0.01 | 0.06 | 0.50 | 0.020 | — | 0.022 | — | 0.012 | 0.0018 | 0.007 | 0.005 |
| Invention steel 20 | 0.0035 | ≦0.01 | 0.06 | 0.50 | — | 0.023 | 0.012 | — | 0.003 | 0.0022 | 0.007 | 0.006 |
| Invention steel 21 | 0.0032 | ≦0.01 | 0.06 | 0.52 | 0.022 | 0.015 | 0.014 | — | 0.015 | 0.0015 | 0.010 | 0.005 |
| Invention steel 22 | 0.0035 | ≦0.01 | 0.11 | 0.55 | — | — | — | 0.0022 | 0.015 | 0.0015 | 0.009 | 0.003 |
| Invention steel 23 | 0.0112 | ≦0.01 | 0.09 | 0.42 | — | — | — | 0.0050 | 0.014 | 0.0019 | 0.009 | 0.004 |
| Invention steel 24 | 0.0304 | ≦0.01 | 0.07 | 0.44 | — | — | — | 0.0009 | 0.009 | 0.0018 | 0.009 | 0.002 |
| Invention steel 25 | 0.0033 | ≦0.01 | 0.06 | 0.52 | — | 0.021 | — | 0.0015 | 0.011 | 0.0018 | 0.007 | 0.002 |
| Invention steel 26 | 0.0029 | ≦0.01 | 0.07 | 0.40 | 0.036 | — | — | 0.0034 | 0.013 | 0.0018 | 0.006 | 0.003 |
| Invention steel 27 | 0.0032 | ≦0.01 | 0.08 | 0.45 | — | — | 0.041 | 0.0020 | 0.010 | 0.0017 | 0.012 | 0.003 |
| Invention steel 28 | 0.0032 | ≦0.01 | 0.05 | 0.43 | 0.030 | 0.011 | — | 0.0025 | 0.010 | 0.0018 | 0.010 | 0.008 |
| Invention steel 29 | 0.0031 | ≦0.01 | 0.06 | 0.43 | 0.024 | — | 0.020 | 0.0024 | 0.011 | 0.0015 | 0.010 | 0.007 |
| Invention steel 30 | 0.0035 | ≦0.01 | 0.06 | 0.45 | 0.022 | — | 0.015 | 0.0020 | 0.012 | 0.0015 | 0.008 | 0.007 |
| Invention steel 31 | 0.0034 | ≦0.01 | 0.07 | 0.48 | — | 0.025 | 0.010 | 0.0012 | 0.005 | 0.0018 | 0.009 | 0.005 |
| Invention steel 32 | 0.0032 | ≦0.01 | 0.07 | 0.41 | 0.030 | 0.010 | 0.020 | 0.0010 | 0.010 | 0.0019 | 0.007 | 0.005 |

TABLE 2

| Steel No. | Final gauge (mm) | Finish rolling temperature (°C.) | Coiling temperature (°C.) | YS (kgf/mm²) | TS (kgf/mm²) | EL (%) | L.D.R. |
|---|---|---|---|---|---|---|---|
| Comparative steel 1 | 1.4 | 900 | 600 | 27.0 | 37.5 | 38 | 1.91 |
| Comparative steel 2 | " | " | " | 25.5 | 33.1 | 43 | 1.94 |
| Comparative steel 3 | " | " | " | 19.8 | 31.5 | 47 | 1.97 |
| Invention steel 4 | " | " | 650 | 18.7 | 27.5 | 53 | 2.06 |
| Invention steel 5 | " | " | " | 20.1 | 27.9 | 52 | 2.06 |
| Invention steel 6 | " | " | " | 20.9 | 29.8 | 51 | 2.02 |
| Invention steel 7 | " | " | " | 22.0 | 30.6 | 50 | 2.03 |
| Comparative steel 8 | " | " | " | 26.4 | 36.7 | 45 | 1.94 |
| Invention steel 9 | " | " | " | 20.7 | 30.9 | 52 | 2.06 |
| Comparative steel 10 | " | " | " | 24.2 | 34.1 | 44 | 1.94 |
| Invention steel 11 | " | " | " | 20.3 | 29.8 | 53 | 2.06 |
| Invention steel 12 | " | " | " | 20.8 | 31.0 | 52 | 2.06 |
| Invention steel 13 | " | " | " | 22.1 | 32.0 | 51 | 2.03 |
| Comparative steel 14 | " | " | 700 | 25.3 | 34.6 | 47 | 1.94 |
| Invention steel 15 | 1.4 | 900 | 700 | 18.0 | 27.7 | 55 | 2.08 |
| Invention steel 16 | " | " | " | 17.5 | 26.5 | 57 | 2.12 |
| Invention steel 17 | " | " | " | 18.1 | 27.4 | 56 | 2.12 |
| Invention steel 18 | " | " | " | 18.7 | 28.3 | 58 | 2.12 |
| Invention steel 19 | " | " | " | 19.0 | 28.3 | 58 | 2.12 |
| Invention steel 20 | " | " | " | 18.2 | 28.1 | 58 | 2.12 |
| Invention steel 21 | " | " | " | 19.1 | 29.0 | 56 | 2.12 |
| Invention steel 22 | " | 780 | 650 | 18.4 | 27.1 | 56 | 2.12 |
| Invention steel 23 | " | " | " | 19.6 | 28.6 | 55 | 2.09 |
| Invention steel 24 | " | " | " | 21.6 | 30.8 | 54 | 2.09 |
| Invention steel 25 | " | 900 | " | 17.3 | 26.6 | 58 | 2.15 |
| Invention steel 26 | " | " | " | 17.3 | 27.1 | 58 | 2.15 |
| Invention steel 27 | " | " | " | 17.8 | 28.2 | 57 | 2.12 |
| Invention steel 28 | " | " | " | 17.2 | 27.3 | 59 | 2.15 |

TABLE 2-continued

| Steel No. | Final gauge (mm) | Finish rolling temperature (°C.) | Coiling temperature (°C.) | YS (kgf/mm²) | TS (kgf/mm²) | EL (%) | L.D.R. |
|---|---|---|---|---|---|---|---|
| Invention steel 29 | " | " | " | 17.4 | 27.6 | 58 | 2.15 |
| Invention steel 30 | " | " | " | 16.4 | 26.9 | 58 | 2.15 |
| Invention steel 31 | " | " | " | 15.8 | 26.2 | 59 | 2.15 |
| Invention steel 32 | " | " | " | 16.6 | 26.8 | 59 | 2.15 |

Figure 2:
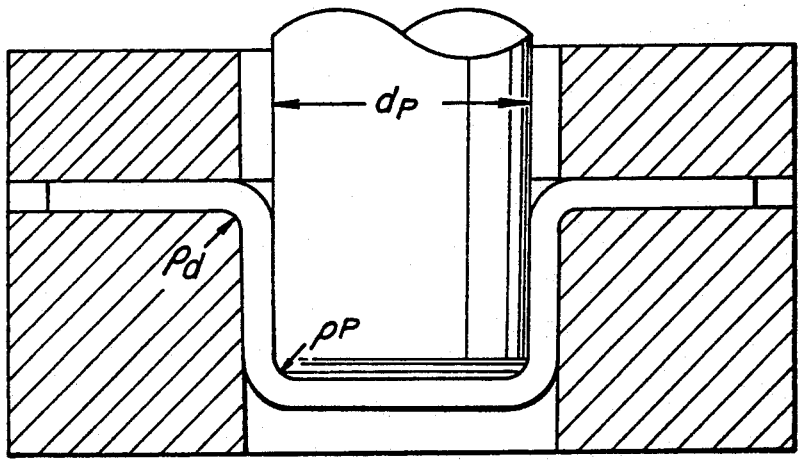
FIG. 2 is a schematic view showing a cupping used for the measurement of limiting drawing ratio.

Moreover, the tensile properties and elongation property were measured with respect to a specimen of JIS No. 5 obtained by subjecting the hot rolled steel sheet of 1.4 mm in thickness to a skin pass rolling of 1.0% and cutting out therefrom in a direction parallel to the rolling direction. The measurement of the limit drawing ratio was carried out by subjecting a specimen cut out from the hot rolled steel sheet of 1.4 mm in thickness after the pickling to cupping as shown in FIG. 2 under conditions as shown in the following Table 3.

TABLE 3

| Automatic Erichsen testing machine (made by Erichsen AG in West Germany) | |
|---|---|
| ponch diameter dP | 33 mm |
| ponch shoulder ρp | 5 mm |
| die shoulder R ρd | 3 mm |
| blank holder | 1 ton |
| Lubrication condition | Nippon Kosaku oil #720 |

As seen from Table 2, all steels according to the invention exhibit the tensile strength of not more than 35 kgf/mm² and total elongation of not less than 50%.

Figure 3:
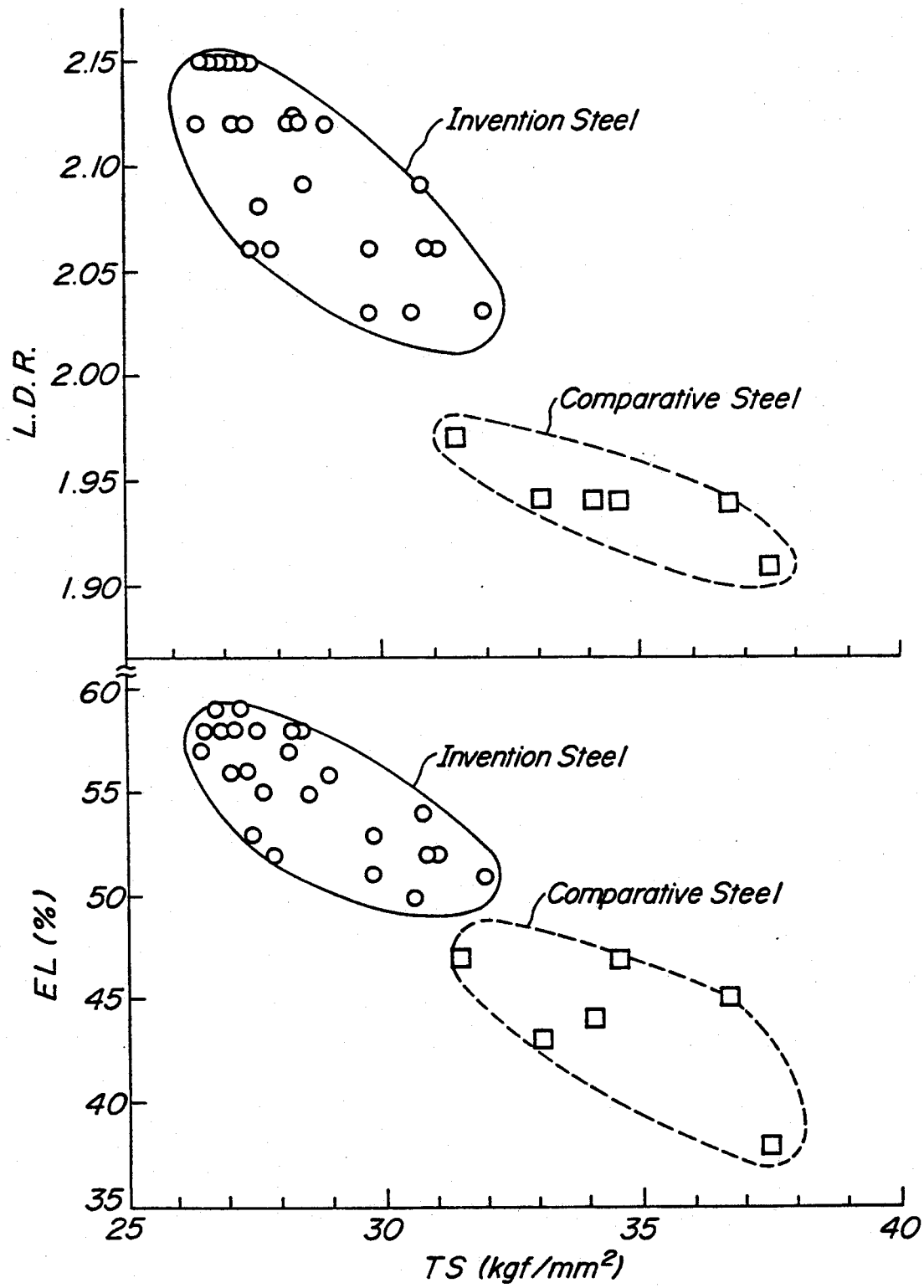
FIG. 3 is a graph showing relationships between tensile strength and total elongation and between tensile strength and limiting drawing ratio in the steel according to the invention and the comparative steel.

In order to clarify the difference between the steel according to the invention and the comparative steel, the relations between tensile strength and total elongation and between tensile strength and limit drawing ratio (L.D.R.) in the invention steels and comparative steels shown in Table 2 are shown in FIG. 3, from which the difference between the invention steel and the comparative steel becomes obvious.

In the hot rolled steel sheet according to the first embodiment, the bad influence of solid solute C is disappears and the ferrite crystal grains ca be made into an optimum regulated grain structure by deleting Mn from the chemical composition range of the conventional flexible hot rolled steel sheet and adding a proper amount of Cr thereto, so that the resulting steel sheet is flexible and excellent in the elongation property as compared with the conventional steel sheet. Therefore, such a hot rolled steel sheet is considerably suitable for deep drawing.

In the hot rolled steel sheet according to the second embodiment, at least one of Ti, Nb and Zr is further contained in addition to the chemical components of the first invention, so that the deep drawability is further improved.

In the hot rolled steel sheet according to the third embodiment, B is contained in addition to the chemical components of the first invention, so that the deep drawability is further improved.

In the hot rolled steel sheet according to the fourth embodiment, at least one of Ti, Nb and Zr and B are included in addition to the chemical components of the first invention, so that the deep drawability is more improved.

What is claimed is:

1. A flexible hot rolled steel sheet having an improved deep drawability, comprising not more than 0.10 wt % of C, less than 0.20 wt % of Mn, 0.20–2.0 wt % of Cr, 0.002–0.100 wt % of Al, and the balance being Fe and inevitable impurities, said sheet having a tensile strength of not more than 35 kgf/mm² and a total elongation of not less than 50%.

2. A flexible hot rolled steel sheet having an improved deep drawability, comprising not more than 0.10 wt % of C, less than 0.20 wt % of Mn, 0.20–2.0 wt % of Cr, 0.002–0.100 wt % of Al, 0.005–0.10 wt % in total of at least one of Ti, Nb and Zr, and the balance being Fe and inevitable impurities, said sheet having a tensile strength of not more than 35 kfg/mm² and a total elongation of not less than 50%.

3. A flexible hot rolled steel sheet having an improved deep drawability, comprising not more than 0.10 wt % of C, less than 0.20 wt % of Mn, 0.20–2.0 wt % of Cr, 0.002–0.100 wt % of Al, 0.0004–0.0100 wt % of B, and the balance being Fe and inevitable impurities, said sheet having a tensile strength of not more than 35 kgf/mm² and a total elongation of not less than 50%.

4. A flexible hot rolled steel sheet having an improved deep drawability, comprising not more than 0.10 wt % of C, less than 0.20 wt % of Mn, 0.20–2.0 wt % of Cr, 0.002–0.100 wt % of Al, 0.005–0.10 wt % in total of at least o ne of Ti, Nb and Zr, 0.0004–0.0100 wt % of B, and the balance being Fe and inevitable impurities, said sheet having a tensile strength of not more than 35 kgf/mm² and a total elongation of not less than 50%.

5. A flexible hot rolled steel sheet having an improved deep drawability comprising not more than 0.10 wt % C, less than 0.20 wt % Mn, greater than 0.4 to 2.0 wt % Cr, 0.002–0.100 wt % Al and the balance being Fe and inevitable impurities.

* * * * *